US009247826B1

(12) United States Patent
Holbrook et al.

(10) Patent No.: US 9,247,826 B1
(45) Date of Patent: Feb. 2, 2016

(54) MATTRESS PAD OR TOPPER HAVING A MESH INSERT

(71) Applicant: Standard Fiber, LLC, Burlingame, CA (US)

(72) Inventors: Russ Holbrook, Matthews, NC (US); Chun Leung Chan, San Francisco, CA (US)

(73) Assignee: Standard Fiber, LLC, Burlingame, CA (US)

( * ) Notice: Subject to any disclaimer, the term of this patent is extended or adjusted under 35 U.S.C. 154(b) by 0 days.

(21) Appl. No.: 14/560,643

(22) Filed: Dec. 4, 2014

(51) Int. Cl.

| | |
|---|---|
| ***A47C 31/00*** | (2006.01) |
| ***A47G 9/02*** | (2006.01) |
| ***A47C 27/00*** | (2006.01) |
| ***A47C 31/10*** | (2006.01) |

(52) U.S. Cl.
CPC ..... *A47C 27/002* (2013.01); *A47C 31/105* (2013.01); *A47G 9/0261* (2013.01); *A47C 31/10* (2013.01)

(58) Field of Classification Search
CPC ..... A47C 27/15; A47C 27/14; A47C 31/105; A47C 31/10; A47G 9/02; A47G 9/0207; A47G 9/0223; A47G 9/0238; A47G 9/0261; A47G 9/00; A47G 2009/001; A47G 9/007; A47G 9/10; A47G 9/1036; A47G 9/1054; A47G 9/0215; A47G 9/0253
USPC ..... 5/691, 690, 502, 500, 499, 482, 724, 5/652.1, 641, 636, 638, 490, 725
See application file for complete search history.

(56) References Cited

U.S. PATENT DOCUMENTS

| | | | | |
|---|---|---|---|---|
| 1,876,591 | A | 9/1932 | Bawden | |
| 2,093,834 | A * | 9/1937 | Gaugler | 4/536 |
| 2,567,072 | A * | 9/1951 | Kay | 5/484 |
| 2,808,596 | A * | 10/1957 | Schreiner | 5/486 |
| 3,141,179 | A * | 7/1964 | McLean | A47C 21/003 5/636 |
| 3,325,832 | A * | 6/1967 | Malicki | 5/487 |
| 3,616,470 | A | 11/1971 | Young | |
| 4,445,241 | A | 5/1984 | Ender et al. | |
| 4,665,575 | A * | 5/1987 | Raught | 5/722 |
| 4,914,772 | A * | 4/1990 | Difloe | 5/652.1 |
| 4,924,541 | A * | 5/1990 | Inagaki | 5/652.1 |
| 4,995,127 | A * | 2/1991 | Inagaki | 5/652.1 |
| 5,005,241 | A * | 4/1991 | Difloe | 5/652.1 |
| 5,038,431 | A * | 8/1991 | Burgin | A47G 9/007 119/28.5 |
| 5,093,946 | A * | 3/1992 | Difloe | 5/652.1 |
| 5,163,194 | A | 11/1992 | Dixon | |
| 5,189,743 | A * | 3/1993 | Difloe | 5/652.1 |
| 5,388,296 | A | 2/1995 | Mansour | |
| 5,522,105 | A * | 6/1996 | Fujiwara | A47G 9/007 128/202.18 |
| 5,546,618 | A * | 8/1996 | Beedy | A47D 15/001 5/423 |
| 5,608,936 | A * | 3/1997 | Nomura | 5/645 |
| 5,687,436 | A * | 11/1997 | Denton | A47C 7/022 297/452.25 |
| 5,706,535 | A * | 1/1998 | Takashima | A47G 9/007 5/485 |
| 5,918,333 | A * | 7/1999 | Takashima | A47G 9/007 5/636 |
| 6,173,675 | B1 * | 1/2001 | Licciardo | A01K 1/0353 119/28.5 |
| D448,229 | S | 9/2001 | Su et al. | |
| 6,408,468 | B1 | 6/2002 | Comfort | |

(Continued)

*Primary Examiner* — Robert G Santos
(74) *Attorney, Agent, or Firm* — Levenfeld Pearlstein, LLC

(57) ABSTRACT

A mattress pad or topper is provided. The mattress pad or topper includes an outer layer defining an interior volume. The outer layer includes a body portion and one or more mesh portions. The mattress pad or topper further includes a filler material disposed within the interior volume. The interior volume is in fluid communication with external atmosphere via the one or more mesh portions.

8 Claims, 1 Drawing Sheet

(56) References Cited

U.S. PATENT DOCUMENTS 6,718,577 B2 * 4/2004 Li ..... 5/482
6,760,935 B1 7/2004 Burton et al.
6,934,985 B2 * 8/2005 Sanders ..... 5/482
7,107,638 B2 * 9/2006 Wilson ..... 5/502
7,143,457 B2 * 12/2006 Macdonald ..... 5/499
7,195,660 B2 * 3/2007 Little ..... A47C 7/383 454/187
7,562,407 B2 * 7/2009 Kuo ..... A47C 7/021 428/71
7,588,291 B2 * 9/2009 Gold et al. ..... 297/219.12
D604,550 S 11/2009 Carter
7,752,691 B2 * 7/2010 Bensoussan ..... A47D 13/08 5/120
8,205,286 B1 * 6/2012 Diaz ..... A47C 20/026 5/630
8,393,025 B2 * 3/2013 Crispino et al. ..... 5/500
8,561,233 B2 * 10/2013 Navan ..... A47G 9/0207 5/652.1
8,646,134 B1 2/2014 Alletto, Jr.
8,745,793 B2 * 6/2014 Bensoussan ..... 5/655
8,869,329 B2 * 10/2014 Shelby ..... A47C 27/002 5/652.1
8,887,332 B2 * 11/2014 Alletto ..... 5/636
8,931,128 B2 * 1/2015 Kiser ..... A47C 27/002 5/655.9
8,950,028 B2 * 2/2015 Navan ..... A47G 9/0207 5/652.1
8,978,185 B1 * 3/2015 Holbrook et al. ..... 5/731
2003/0028964 A1 * 2/2003 Li ..... 5/482
2004/0231055 A1 * 11/2004 Sanders ..... 5/502
2005/0193490 A1 * 9/2005 Macdonald ..... 5/500
2005/0229557 A1 * 10/2005 Little ..... A47C 7/383 55/385.1
2006/0130235 A1 * 6/2006 Wilson ..... 5/502
2007/0283498 A1 * 12/2007 Shelby ..... A47C 27/002 5/706
2008/0244832 A1 10/2008 Kuo
2009/0001801 A1 * 1/2009 Gold et al. ..... 297/452.47
2009/0241264 A1 * 10/2009 Bensoussan ..... A47D 13/08 5/695
2010/0154122 A1 * 6/2010 Crispino et al. ..... 5/636
2010/0235992 A1 * 9/2010 Bensoussan ..... 5/424
2010/0306923 A1 * 12/2010 Navan ..... A47G 9/0207 5/652.1
2011/0154575 A1 * 6/2011 Kiser ..... A47C 27/002 5/706
2014/0096323 A1 * 4/2014 Alletto ..... 5/644
2014/0196215 A1 * 7/2014 Navan ..... A47G 9/0207 5/652.1
2014/0196216 A1 * 7/2014 Weitzel et al. ..... 5/691

* cited by examiner

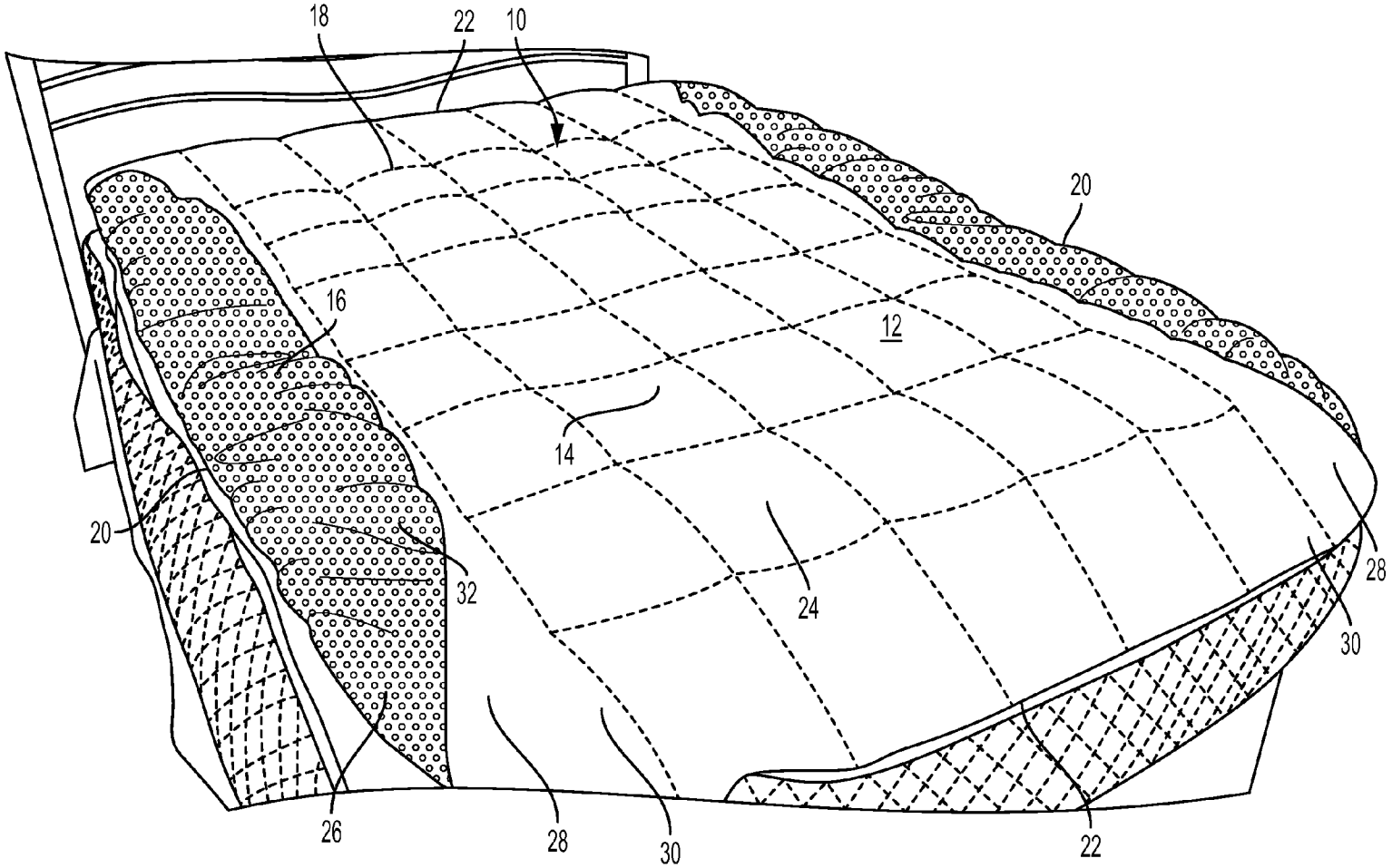
10
12
14
16
18
20
22
24
26
28
30
32

MATTRESS PAD OR TOPPER HAVING A MESH INSERT

BACKGROUND

The following description relates to a mattress pad or topper, and in particular, a mattress pad or topper having a mesh insert.

A mattress pad or topper is generally fitted to, or positioned on a top side of a mattress, i.e., a side of the mattress configured to support a person, such that a person using the mattress to sit, lie, rest or otherwise support themselves thereon, may additionally be supported by the mattress pad. The mattress pad is often used to provide increased comfort, compared to the mattress alone, by providing additional cushioning and/or support.

The mattress pad or topper generally includes a padded top surface configured to be positioned on the top side of the mattress. The padded surface may generally be formed by one or more pieces of material, such as a fabric material, positioned relative to one another to define an inner volume. The inner volume is configured to receive a padding material, which acts as a cushion or padding for the padded surface. The one or more pieces of material may be, for example, two pieces of material stitched together at respective peripheral edges. The mattress pad may further include depending sides or edges extending from the padded surface that are configured to fit around corresponding sides of the mattress. The depending sides may include an elastic material so that the depending sides snuggly engage the sides of mattress to secure the mattress pad to the mattress.

A mattress pad is typically made from a single fabric or blend of fabrics, and, as described above, may include a filling or other padding material therein. These fabrics and/or filling may retain heat, for example, when in contact with a person, causing an increase in temperature that the person may find uncomfortable. In some cases, the heat retention is caused by a restricted flow of air through the mattress pad, allowing body heat from the person to be retained. That is, in some cases, a breathability, or ability for air to flow between the inner volume of the mattress and the outer, ambient air may be restricted, especially in areas in direct contact with the person, allowing for a build of heat. In other cases, breathability may be restricted by other bedding articles, such as blankets or linens coming into contact with the mattress pad.

Accordingly, it is desirable to provide a mattress pad that may limit or prevent heat retention.

SUMMARY

According to one embodiment, there is provided a mattress pad or topper. The mattress pad or topper includes an outer layer defining an interior volume. The outer layer includes a body portion and one or more mesh portions. The mattress pad or topper further includes a filler material disposed within the interior volume. The interior volume is in fluid communication with the external atmosphere via the one or more mesh portions.

Other objects, features, and advantages of the disclosure will be apparent from the following description, taken in conjunction with the accompanying sheets of drawings, wherein like numerals refer to like parts, elements, components, steps, and processes.

BRIEF DESCRIPTION OF THE DRAWINGS

FIG. 1 is a top view of an example of a bedding article according to one embodiment of the present invention.

DETAILED DESCRIPTION

While the present disclosure is susceptible of embodiment in various forms, there is shown in the drawings and will hereinafter be described one or more embodiments with the understanding that the present disclosure is to be considered illustrative only and is not intended to limit the disclosure to any specific embodiment described or illustrated.

FIG. 1 is a perspective view of a mattress pad or topper 10 according to an embodiment described herein. Referring to FIG. 1, the mattress pad 10 includes an outer layer 12 of material, the outer layer 12 including a body portion 14 and one or more mesh portions 16. The outer layer 12 is constructed to define an interior volume. The outer layer 12 includes a first side 18 and a second side (not shown) opposite to the first side. In one embodiment, the first side 18 may be a top side of the mattress pad 10 and the second side may be a bottom side. An edge region extends about a periphery of the mattress pad 10 and outer layer 12 at a boundary between the first side and the second side. In one embodiment, the outer layer 12 may be substantially rectangular or square shaped, to correspond to a shape of a top surface of a mattress. Accordingly, the outer layer 12 may include two opposed longitudinal edges 20 extending in a length direction '1' and two opposed transverse edges 22 extending in a width direction 'w' between the two opposed longitudinal edges 20.

The body portion 14 may be constructed of one or more panels of material. For example, a single panel of material may extend substantially about the interior volume. In another example, the body portion 14 may include a first panel that generally corresponds to the first side 18 and a second panel that generally corresponds to the second side. The first and second panels may be connected together, for example, along portions of the longitudinal edges 20 and/or the transverse edges 22. In one embodiment, the body portion 14 may or may not be quilted. The body portion 14 may also be formed, for example, in a fitted manner, as is a fitted sheet. In an embodiment, a first panel corresponding to the first side 18 and a second panel corresponding to the second side may be stitched to one another to form a plurality of boxes 24 across a surface of the body portion 14. The stitching may extend between the panels, across the interior volume, such that the interior volume is divided into spaces corresponding to the boxes 24. In another embodiment, the body portion 14 may include two or more panels at each side (i.e., the first side 18 and the second side) of the outer layer 12. In some embodiments, the panels may be formed by more than one ply of the material.

It is understood that additional panels, plies, strips or portions of material may be included in the outer layer 12. For example, a gusset may be formed between the first side 18 and second side to allow for a larger interior volume. It is also understood that panels may be connected along portions of the longitudinal edges 20 and/or transverse edges 22, for example, by stitching or with a releasable fastener such as, but not limited to, a slide fastener, a hook and loop fastener, buttons, snaps, adhesives or other similar known fasteners. Similar fasteners may be used to connect panels to one another away from the edge region as well. The material from which the body portion 14 is formed may be a natural or synthetic woven material including a fabric material, such as a knitted fabric, a sateen weave, or any flat weave fabric.

The one or more mesh portions 16 may be formed by the same materials as the body portion 14. Alternatively, or in addition, the one or more mesh portions 16 may be made of nylon, polyester or another similar material. The one or more mesh portions 16 include a plurality of openings 26. In one embodiment, the openings 26 are positioned at regular, consistently spaced intervals along the one or more mesh portions 16. That is, equal spacing may exist between each opening 26 and the nearest adjacent opening or openings 26. The openings 26 may all be similarly shaped and sized. Alternatively, the one or more mesh portions 16 may be manufactured with openings 26 having predetermined sizes and shapes that vary among one another. Accordingly, the one or more mesh portions 16 are configured to allow an increased flow of air into and out of the interior volume, per unit area, than the body portion 14.

In one embodiment, and with further reference to FIG. 1, the one or more mesh portions 16 may include two mesh portions 16, spaced apart from another by the body portion 14. In one embodiment, the mesh portions 16 may be positioned at opposite edges of the mattress pad 10. For example, each mesh portion 16 may extend along at least a portion of a respective longitudinal edge 20 or a respective transverse edge 22. Each mesh portion 16 may be secured to the body portion 14, for example, by stitching, adhesive or other suitable fastening mechanism.

In one embodiment, each mesh portion 16 may extend generally in the length direction '1' along respective longitudinal edges 20. The mesh portions 16 may also extend inwardly in the width direction 'w' toward a center of the outer layer 12. Each mesh portion 16 may be arced or bowed inwardly in the width direction 'w', such that each mesh portion 16 varies in width along at least a portion thereof. It is understood that while each mesh portion 16 may be arced or bowed along its entire length, the present disclosure is not limited thereto. Each mesh portion 16 may include, for example, at least one flat or substantially linear portion along its length. It is understood that the present disclosure is not limited to this configuration, however. For example, each mesh portion 16 may extend generally in the width direction 'w' along a respective transverse edge 22, extend inwardly toward a center of the outer layer in the length direction '1', and be spaced apart from one another in the length direction '1'.

In some embodiments, the outer layer 12 may further include opposed combined channels 28, each combined channel 28 including at least a portion of the body portion 14 and one of the one or more mesh portions 16. In one embodiment, each combined channel 28 is defined by a seam 30 extending in the length direction '1' and a respective longitudinal edge 20. The seam 30 may serve as a boundary between the combined channel 28 and a remainder of the body portion 14. Each combined channel 28 may have a different stitching or boxing pattern than the remainder of the body portion 14 between the combined channels 28. In some embodiments, the combined channels 28 do not include any boxing 24.

It is understood that the present disclosure is not limited to the configurations above. For example, the combined channels 28 may also extend in the width direction 'w'. In addition, it is understood that the mesh portion 16 may include more than two mesh portions 16. For example, additional discrete, i.e., spaced apart, mesh portions 16 may be included. The additional mesh portions may be positioned along the longitudinal edges 20 and/or transverse edges 22 or at intermediate or interior positions of the outer layer 12, spaced from the edges 20, 22. Further, it is understood that although the mattress pad 10 is shown as being generally rectangular or square in shape, that it may be made in other shapes to correspond to differently shaped mattresses.

In one embodiment, the mesh portions 16 may extend from a position on the first side 18 to a respective longitudinal or transverse edge 20, 22, and around to a position on the second side of the outer layer 12, such that the second side of the outer layer 12 is substantially identical to the first side 18. In some embodiments, the mesh portions 16 may extend along the entire length of a respective longitudinal or transverse edge 20, 22. However, the present disclosure is not limited to such a configuration. For example, the mesh portions 16 may extend only partially along an entire length or width of the outer layer 12. In some embodiments, the mesh portions 16 may extend only to a respective longitudinal or transverse edge 20, 22 and not to the second side. In other embodiments, the mesh portions 16 are formed in different patterns or profiles on the first side 18 and the second side. In still other configurations, the one or more mesh portions 16 are spaced from the longitudinal and/or transverse edges 20, 22.

The mattress pad 10 further includes a padding or filler material 32 disposed within the interior volume, i.e., between the first side 18 and the second side. The filler material 32 may be, for example a fibrous or foam material. In one embodiment, the filler material 32 may be, for example, a polyester fiber. In some embodiments, the filler material 32 may be disposed in the boxes 24. The filler material 32 may increase a thickness of the mattress pad 10, thereby providing a cushioning, padding and/or supporting effect to a person sitting, laying, resting or otherwise supporting themselves on the mattress pad 10.

In some embodiments, the mattress pad 10 may include depending sides extending from the outer layer 12. The depending sides are configured to fit around a perimeter of the mattress. Alternatively, or in combination with the depending sides, the mattress pad 10 may include straps, for example, elastic straps, configured to fit around portions of the mattress to secure the mattress pad 10 to the mattress.

In the embodiments above, a mattress pad 10 includes one or more mesh portions 16 having openings 26 formed therein to allow increased air flow, relative to the body portion 14, between the interior volume and the external atmosphere. In addition, the body portion 14 is positioned between the mesh portions 16 and is configured for contact with the person or user. The body portion 14 may be formed or constructed having, for example, different, cushioning, softness and stiffness characteristics than the mesh portions 16. For example, as detailed above, the body portion 14 may or may not be quilted. Accordingly, in the embodiments above, the outer layer 12 may be well suited for supporting a person thereon at the body portion 14, while providing sufficient breathability via the mesh portions 16 so as to limit or prevent increases in temperature.

It should also be understood that various changes and modifications to the presently disclosed embodiments will be apparent to those skilled in the art. Such changes and modifications can be made without departing from the spirit and scope of the present disclosure and without diminishing its intended advantages. It is therefore intended that such changes and modifications be covered by the appended claims.

The invention claimed is:

1. A mattress pad for fitting onto and extending over a top surface of a mattress, the mattress pad comprising:

an outer layer defining an interior volume substantially coextensive with the outer layer, the outer layer having a top side, a non-mesh body portion and one or more mesh portions each being spaced apart from a center of the top side, the body portion and the one or more mesh portions being substantially coplanar and positioned on the top side; and a filler material disposed within the interior volume, wherein the interior volume is configured to be in constant fluid communication with the external atmosphere via the one or more mesh portions such that air flows substantially throughout the filler material and the interior volume.

2. The mattress pad of claim 1, wherein the one or more mesh portions includes two mesh portions spaced apart by the body portion.

3. The mattress pad of claim 2, wherein the outer layer includes opposed longitudinal edges extending in a length direction, and each mesh portion extends along at least a portion of a respective longitudinal edge.

4. The mattress pad of claim 3, wherein each mesh portion extends inwardly in a width direction on the top side from a respective longitudinal edge, and each mesh portion varies in width along at least a portion thereof.

5. The mattress pad of claim 1, wherein the body portion is made from a quilted fabric.

6. The mattress pad of claim 5, wherein the body portion includes a plurality of boxes, wherein the filler material is disposed in the boxes.

7. The mattress pad of claim 1, wherein the body portion is made from a knitted fabric, sateen weave or flat weave fabric.

8. The mattress pad of claim 1, wherein the filler material is polyester.

* * * * *